United States Patent [19]

Tanaka et al.

[11] Patent Number: 4,696,462

[45] Date of Patent: Sep. 29, 1987

[54] PAPER SUPPLYING DEVICE

[75] Inventors: Hironori Tanaka; Masafumi Matsumoto; Matahira Kotani, all of Nara, Japan

[73] Assignee: Sharp Kabushiki Kaisha, Osaka, Japan

[21] Appl. No.: 790,962

[22] Filed: Oct. 24, 1985

[30] Foreign Application Priority Data

Oct. 27, 1984 [JP] Japan ..... 59-226226
Oct. 27, 1984 [JP] Japan ..... 59-226227

[51] Int. Cl.[4] ..... B65H 3/06

[52] U.S. Cl. ..... 271/10; 271/118; 271/119; 271/121; 271/126

[58] Field of Search ..... 271/10, 110, 111, 114, 271/118, 119, 121, 124, 126

[56] References Cited

U.S. PATENT DOCUMENTS 3,937,455 2/1976 Hauser ..... 271/119 X
4,232,860 11/1980 Brown ..... 271/119
4,286,908 9/1981 Pfaffle ..... 271/160 X
4,458,890 7/1984 Kawazu ..... 271/121 X
4,568,074 2/1986 Murayoshi ..... 271/119 X
4,585,223 4/1986 Tam ..... 271/160 X

*Primary Examiner*—Richard A. Schacher
*Attorney, Agent, or Firm*—Birch, Stewart, Kolasch & Birch

[57] ABSTRACT

A paper supplying device including first feed rollers eccentrically mounted on a horizontal rotational shaft, having convex feed surfaces whereby the feed rollers are capable of coming in contact with a first surface of a paper to fed, pressure rollers disposed as to face the feed surfaces of the feed rollers, for urging the paper toward the feed rollers while contacting the other surface of the paper, a separating plate arranged at the downstream side of the first feed rollers with respect to a feeding direction of the paper, for interrupting the movement of remaining sheets of paper other than the paper in contact with the convex feed surfaces of the first feed rollers, second feed rollers arranged at the downstream side of the first feed rollers with respect to the feeding direction of the paper, for feeding the paper in contact with the feed surfaces, according to an angular displacement of the first feed rollers and a transport arranged at a downstream side of the second feed rollers with respect to the feeding direction of the paper.

5 Claims, 12 Drawing Figures

PAPER SUPPLYING DEVICE

BACKGROUND OF THE INVENTION

The present invention generally relates to a paper feeding arrangement and more particularly, to a paper supplying device, which is employed for example, in an image recorder such as a telecopier, copying machine or the like, for automatically supplying in turn a plurality of original documents stacked on sheet upon another.

A typical prior art paper supplying device is provided with a pair of cylindrical auxiliary rollers facing pressure rollers which are capable of pressing against the auxiliary rollers, a pair of paper feed rollers held in contact with friction members and a pair of transport rollers, all of which rollers being arranged from the upstream side toward the downstream side with respect to the feeding direction of the original document. A plurality of original documents supplied by way of the auxiliary rollers and the pressure rollers are separated sheet by sheet by the paper feed rollers in combination with the pressure rollers and thereafter each separated paper is fed to a read unit by the transport rollers. Each of the auxiliary rollers, the paper feed rollers and the transport rollers has an axial length longer than the width of the original document so as to supply the original document steadily by decreasing uneven widthwise feeding force.

In the known construction as described so far, however, since the auxiliary rollers are formed cylindrical in shape, the original document is always pressed between the auxiliary rollers and the pressure rollers and accordingly, the paper feed rollers are required to be made larger in size in order to feed the original documents sheet by sheet with certainty. Furthermore, the original documents are subject to being damaged by large tension acting thereon, when being supplied. In addition, since a plurality of the rollers are long, the device itself becomes large in size and as a result, the rollers must be manufactured at a high cost.

SUMMARY OF THE INVENTION

Accordingly, an essential object of the present invention is to provide an improved paper supplying device capable of steadily supplying original documents sheet by sheet without an excessive feeding force being applied thereon.

Another important object of the present invention is to provide a paper supplying device of the above described type of a compact size with increased paper feed performance.

In accomplishing these and other objects, according to one preferred embodiment of the present invention, there is provided a paper supplying device including a first feed means with a horizontal rotatonal axis, having a convex feed surface whereby the feed means is capable of coming in contact with one surface of a paper to be fed, an urging means disposed so as to face the feed surface of the feed means for urging the paper toward the feed means while contacting the other surface thereof, an interrupting means arranged at the downstream side of the feed means with respect to the feeding direction of the paper, for interrupting the movement of the remaining papers other than the paper being in contact with the feed surface of the feed means, a second feed means arranged at the downstream side of the first feed means with respect to the feeding direction of the paper for feeding the paper in contact with the feed surface according to an angular displacement of the first feed means, and a transport means arranged at the downstream side of the second feed means with respect to the feeding direction of the paper.

By the arrangement according to the present invention as described above, since the feed means has the convex feed surface, the original document can be fed only when the feed surface is in contact with the urging means and accordingly, as compared with the prior art arrangements wherein the feed surface of the feed means is in contact with the original document at all times, the damage of the original document is appreciably reduced owing to the fact that the feeding force does not act thereon excessively. In addition, since the transport members of the transport means can be shortened, a small-sized paper supplying device can be obtained.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE EMBODIMENTS

Figure 1:
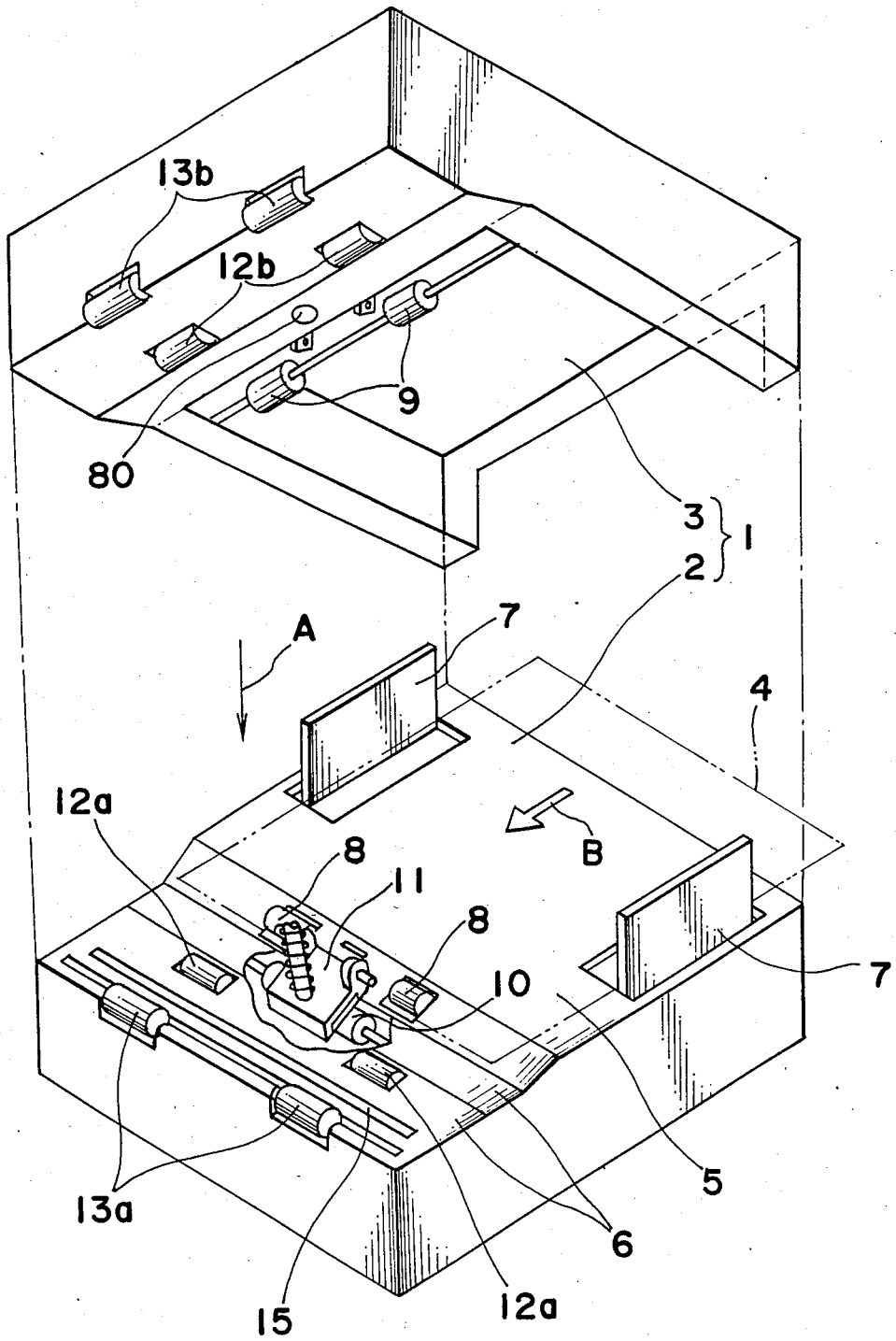
FIG. 1 is an exploded perspective view of the paper supplying device according to one preferred embodiment of the present invention.

Before the description of the present invention proceeds, it is to be noted that like parts are designated by like reference numerals throughout the accompanying drawings.

Figure 2:
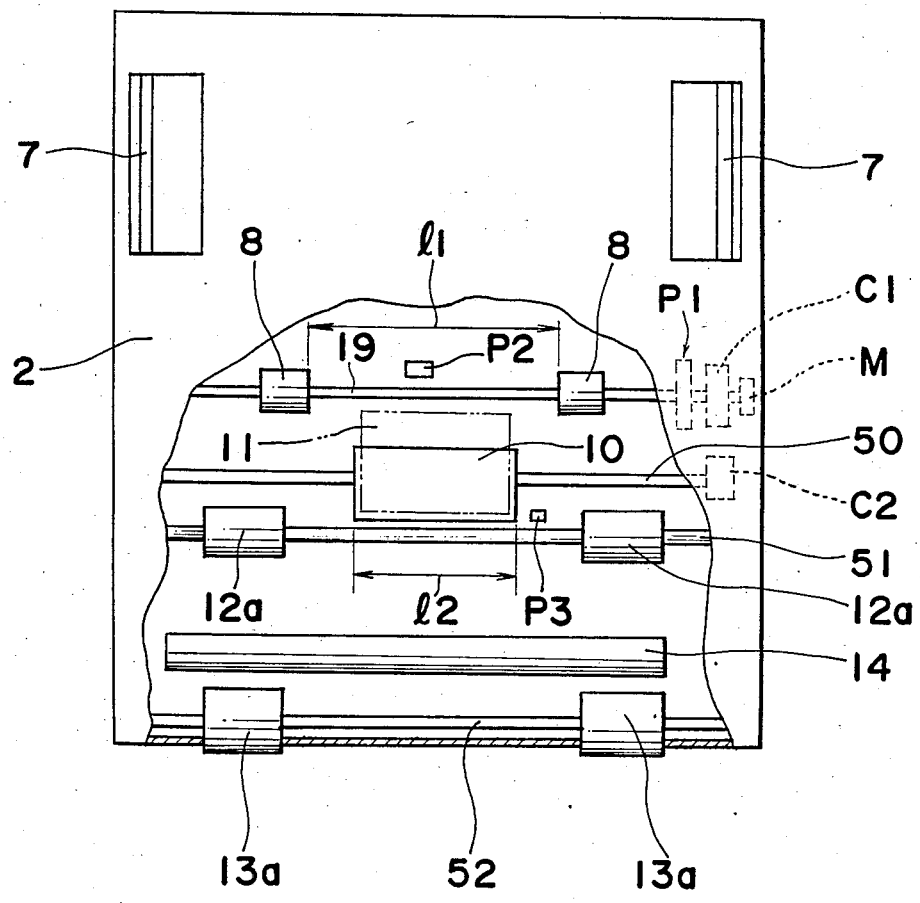
FIG. 2 is a top plan view as observed in the direction of an arrow A in FIG. 1 with portions thereof broken away.
Figure 3:
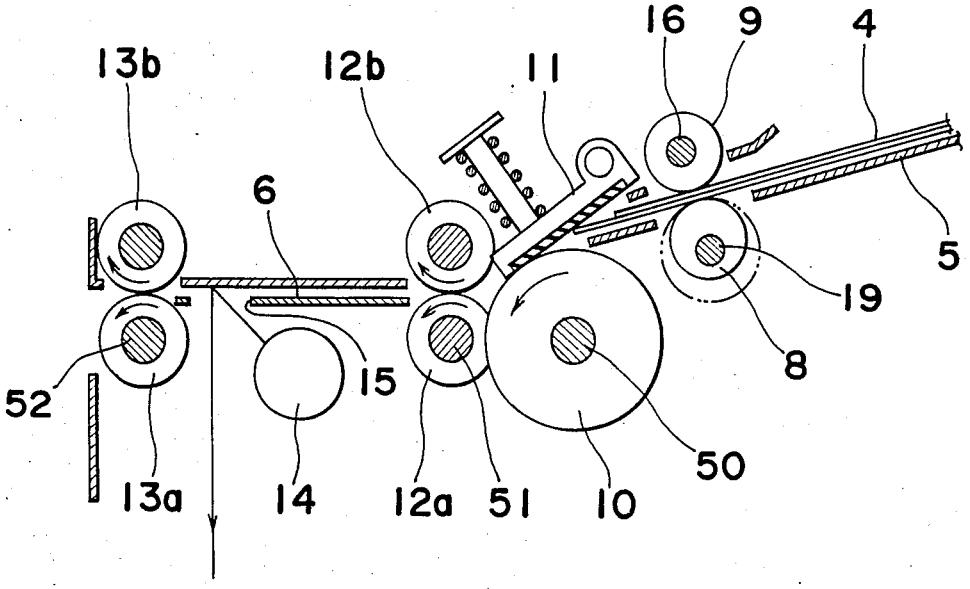
FIG. 3 is a side sectional view of the paper supplying device schematically showing the inner structure thereof.

Referring first to FIGS. 1 through 3, the paper supplying device, generally shown by 1, having a main body 2 and a cover 3 includes a document platform 5 whereon the original documents 4 are set and a paper transport surface 6 forming a paper transport passage whereon papers are transported, at the upper surface thereof. Each of a pair of guides 7 is arranged in the vicinity of each side of the rear end on the document platform 5 of the device 1 so as to lead each original document 4 with certainty. A pair of spaced feed rollers 8, each being cylindrical in shape, are provided as feed members for feeding the original document 4 at the downstream side in a direction indicated by arrow B such that the original documents 4 are fed on the document platform 5. A pair of spaced pressure rollers 9 are arranged on the cover 3 for making a pair with the feed rollers 8. Both of the feed rollers 8 and the pressure rollers 9 jointly constitute a feed means for feeding the original document 4 along the direction B in which the original documents 4 are fed.

A separating plate 11 is arranged at the downstream side of the feed rollers 8 so as to be resiliently engaged with the peripheral surface of a paper feed roller 10 and the original documents 4 are separated sheet by sheet by the separating plate 11 in combination with the paper feed roller 10. Pairs of spaced upper and lower transport rollers **12*b* and 12*a* respectively, and another pair of spaced upper and lower transport rollers 13*b* and 13*a* respectively, are also arranged at the downstream side of the paper feed roller 10, while the respective pairs of the upper and lower rollers are juxtaposed with each other. A plurality of original documents 4 placed on the document platform 5 are transported toward the paper feed roller 10 by the feed rollers 8 and the pressure rollers 9, as described later and each original document 4 separated by the paper feed roller 10 and the separating plate 11 is transported between upper and lower transport rollers 12*b* and 12*a* respectively, along the paper transport surface 6 so as to be discharged to a sorter (not shown) by another upper and lower transport rollers 13*b* and 13*a* respectively. Light from a light source 14 provided at the downstream side of the paper transport surface 6 is applied to the original document 4 through a slit 15 arranged thereon and reflected light from the original document 4** is directed to a read unit through an optical system (not shown) such as reflex mirrors, lenses or the like. Thereafter, an image of the original formed on an image sensor in the read unit is read by being changed to electric signals.

Figure 4:
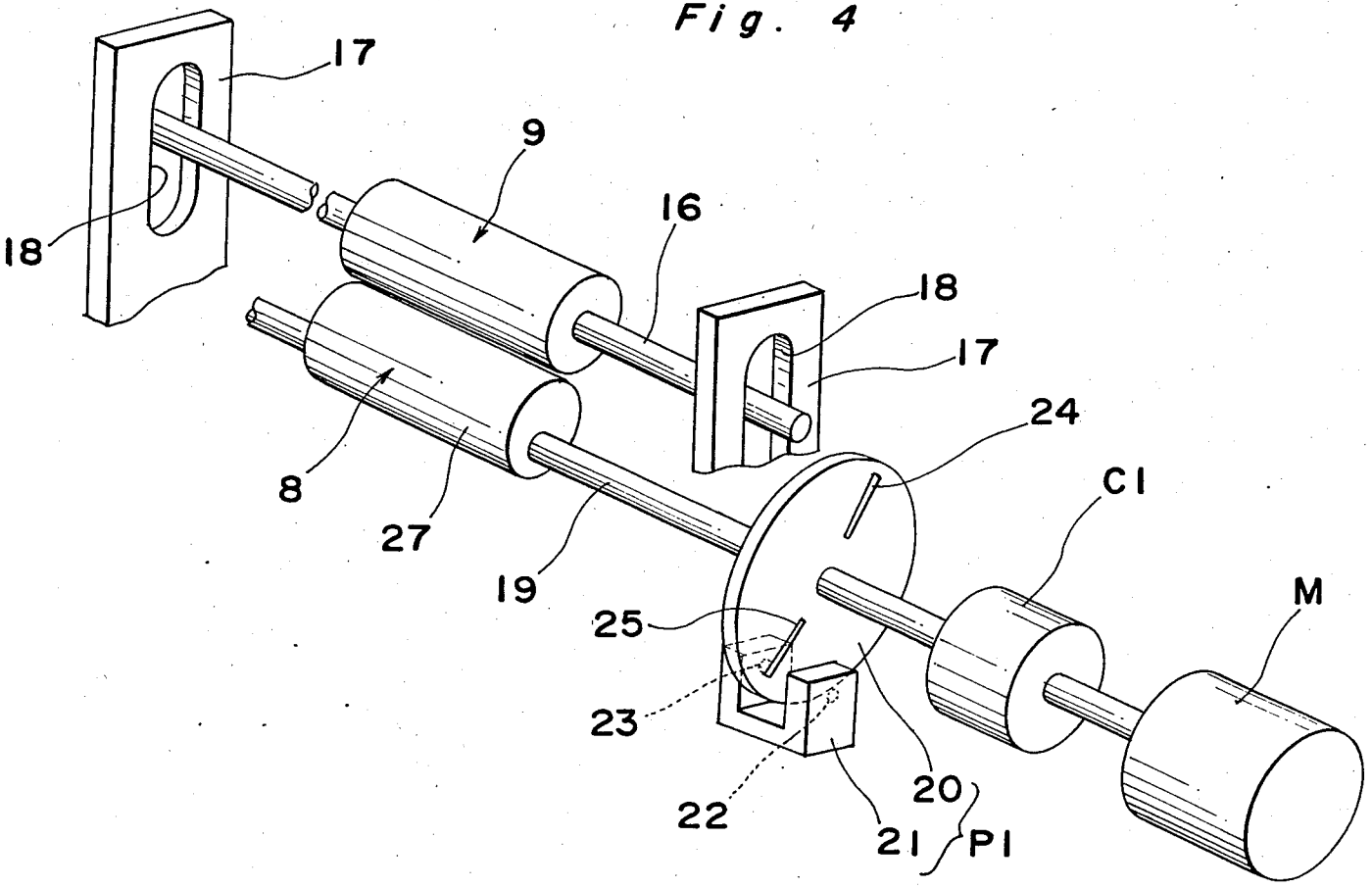
FIG. 4 is a perspective view, on an enlarged scale, in the vicinity of the feed rollers and the pressure rollers employed in the paper supplying device of FIG. 1.

In FIG. 4, since each end of a rotary shaft 16 of the pressure rollers 9 is loosely inserted in an elongated opening 18 of each holding member 17, each pressure roller 9 is capable of being in contact with each feed roller 8 under a certain pressure by its own weight.

Each feed roller 8 is eccentrically mounted on a horizontal rotary shaft 19 for rotation together therewith, one end of which shaft 19 is connected with an output shaft of a motor M though an electromagnetic clutch C1. A detecting means P1 arranged between one of the feed rollers 8 and the electromagnetic clutch C1 for detecting an amount of angular displacement of the feed rollers 8, comprises a light shielding plate 20, fixed to the rotary shaft 19, and a photointerrupter 21 which includes a light emitting element 22 and a light receiving element 23 disposed on one side of the light shielding plate 20 opposite to the light emitting element 22.

Figure 5:
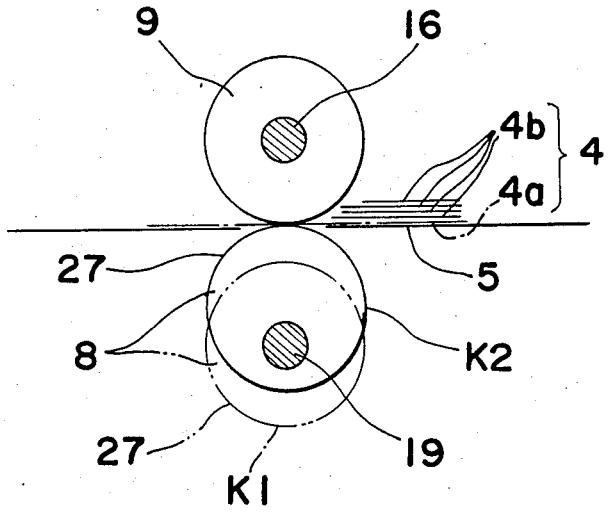
FIG. 5 is a side sectional view of the feed rollers and the pressure rollers of the paper supplying device showing a mutual connection therebetween.

The light shielding plate 20 has first and second slits 24 and 25 defined therein at respective locations corresponding to a first position, where the peripheral surfaces 27 of the pair of the feed rollers 8 are spaced a maximum distance from the document platform 5 as shown in FIG. 5, and a second position where the surfaces 27 are level with the document platform 5.

When the light receiving element 23 has received the light from the light emitting element 22 through the slit 24 as the shielding plate 20 rotates, the rotation of the feed rollers 8 are brought to a halt at the first position as stated above. To the contrary, when the light receiving element 23 has received the light through the slit 25, the feed rollers 8 are brought to a halt of the rotation thereof at the second position.

Referring also to FIG. 5, since the feed rollers 8 have the eccentric rotary shaft 19, as has been stated, the peripheral surfaces 27 of the feed rollers 8 having a function for transporting the original document 4 while contacting the lower surface thereof, come in contact with the pressure rollers 9 at a first position indicated by a solid line K2 and subsequently, is spaced a maximum distance therefrom at a second position indicated by an imaginary line K1 during one revolution of the feed rollers 8.

Figure 6:
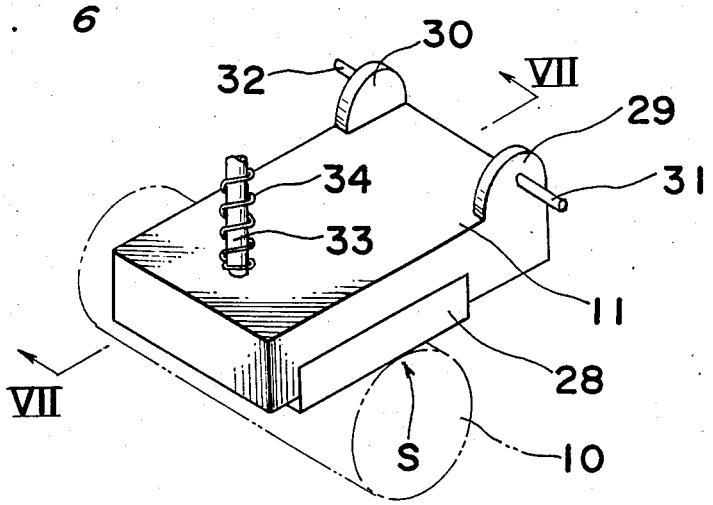
FIG. 6 is a perspective view, on an enlarged scale, of the separating plate employed in the paper supplying device of FIG. 1.
Figure 7:
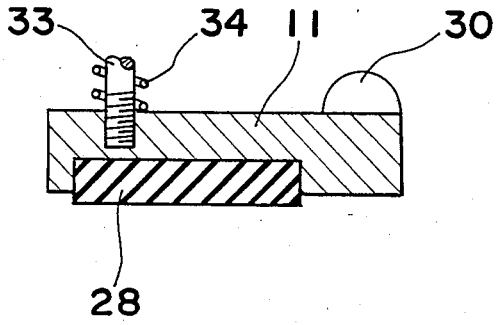
FIG. 7 is a sectional view taken along the line VII—VII in FIG. 6.

In FIGS. 6 and 7, there is shown the separating plate 11 with a lower surface whereon a material having a large friction coefficient, for example, a friction member 28 made of rubber, urethane or the like is attached. A pair of brackets 29 and 30 arranged at the rear portion of the separating plate 11, are provided with supporting shafts 31 and 32 respectively, which are rotatably sustained on the cover 3 and extend outwardly in a direction perpendicular to the direction B in which the original documents 4 are fed. Accordingly, the separating plate 11 is capable of rotating around an axis of the supporting shafts 31 and 32. The separating plate 11 is provided with another supporting shaft 33 extending upwardly therefrom, and having one end connected to the upper surface thereof and the other end loosely inserted into an opening 80 arranged on the cover 3, as shown in FIG. 1. The supporting shaft 33 is encircled by a spiral spring 34 having one end in contact with the separating plate 11 and the other end in contact with the inner wall of the cover 3, and consequently, the separating plate 11 is urged toward the paper feed roller 10. According to the above described configurations, when the original documents 4 are transported on the paper feed roller 10, the lowest one **4*a* of the original documents 4 in contact with the roller 10 is separated from the other original documents 4*b* for transportation thereof at a separation point S whereat the roller 10 is in contact with the separating plate 11, and the remaining original documents 4*b* are interrupted in the transportation thereof by the friction member 28**.

Referring back to FIG. 2, the paper feed roller 10 is disposed around the central portion of the main body 2 and the feed rollers 8 are arranged in the vicinity of the paper feed roller 10 at the upstream side thereof. Since the feed rollers 8 are so placed such that a distance 11 between both rollers 8 is longer than a shaft length 12 of the paper feed roller 10, when one of the original documents 4 is transported by the paper feed roller 10 from the feed rollers 8, the fact that a feeding force uniformly acts on approximately all over the surface of the original document 4 results in steady feed of each original document 4 without the original document 4 being obliquely fed or a plurality of original documents 4 being simultaneously fed.

In addition, since the feed rollers 8 are disposed in the vicinity of the paper feed roller 10, pliable original documents such as single-ply papers can be retained flat without permitting it to bend arbitrarily and a relatively wide variety of the original documents in thickness can be steadily fed in high reliability.

The lower transport rollers **12*a*, as well as the other lower transport rollers 13*a*, are disposed on respective sides of the paper feed roller 10 and on the downstream side with respect to the feeding direction of the original document, and accordingly, the original document 4 fed by the paper feed roller 10 is passed through a nipping area between the feed roller 10 and the separating plate 11 and then through a nipping area, defined between the upper and lower transport rollers 12***b* and 12*a*, and also a nipping area defined between the upper and lower transport rollers 13*b* and 13*a* with increased paper feed performance.

A detecting means P2 is arranged between the feed rollers 8 and the paper feed roller 10 for detecting whether or not, one or more original documents are placed on the document platform 5. Another detecting means P3 is also arranged between the paper feed roller 10 and the transport rollers 12*a* for detecting each end of each original document 4.

Rotary shafts 19, 50, 51 and 52 of the feed rollers 8, the paper feed roller 10, the transport rollers 12*a* and another transport rollers 13*a* respectively, extending horizontally, are parallel with one another and are driven by the motor M for rotation thereof. Furthermore, the pressure rollers 9, the transport rollers 12*b* and transport rollers 13*b* mounted on the cover 3, follow the feed rollers 8, the transport rollers 12*a* and transport rollers 13*a* respectively for rotation thereof. An electromagnetic clutch C2 is disposed at one end of the rotary shaft 50 as illustrated at the right end thereof in FIG. 2, for controlling the movement of the paper feed roller 10.

Figure 8:
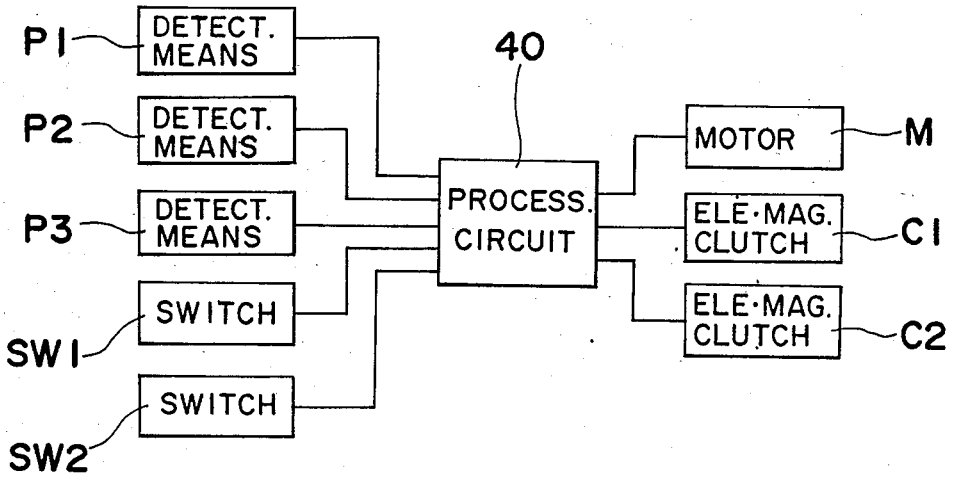
FIG. 8 is a block diagram showing a control mechanism for controlling the position of the feed rollers.

As shown in FIG. 8, detecting means P1, P2 and P3, an electric source switch SW1 and a switch and a switch SW2 for transmission are connected to a processing circuit 40 wherein the motor M and the electromagnetic clutches C1, C2 are controlled by receiving signals from the detecting means P1, P2 and P3, and the switches SW1 and SW2 as described above.

Figure 9:
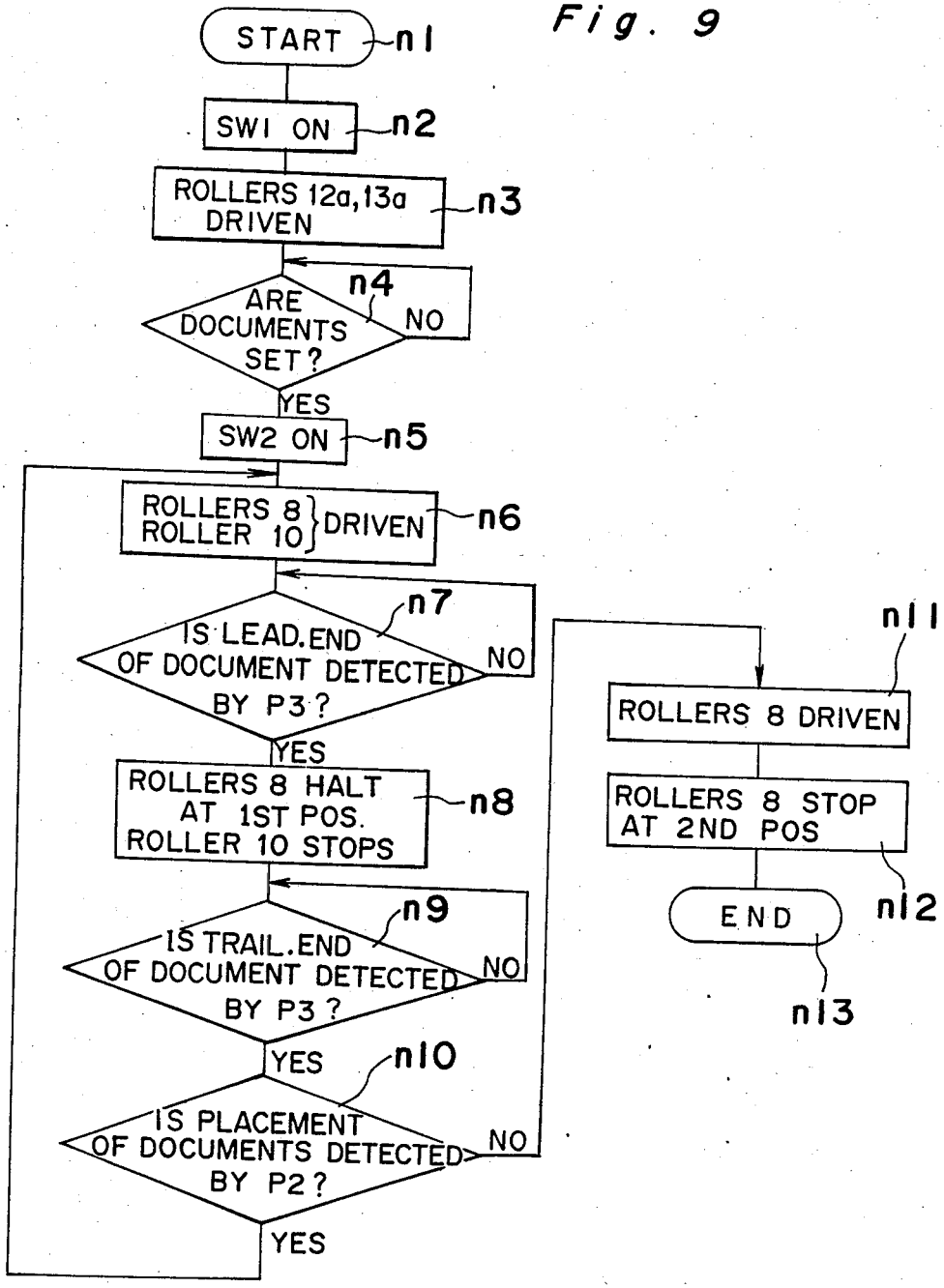
FIG. 9 is a flow-chart for explaining the paper supplying movement of the paper supplying device.
Figure 10:
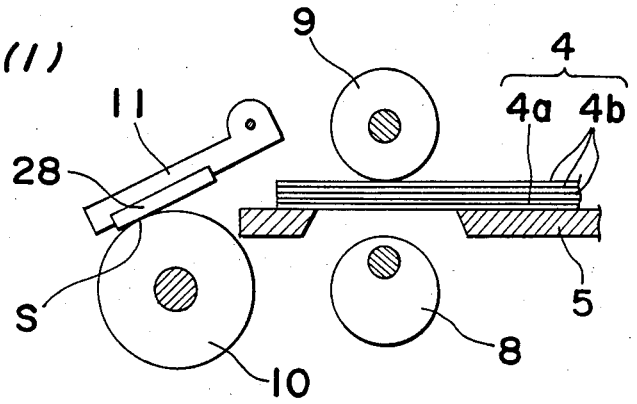
FIGS. 10(1) through 10(3) are a series of drawings showing the mutual connection between the feed rollers and the original documents, when the documents are supplied.
Figure 10:
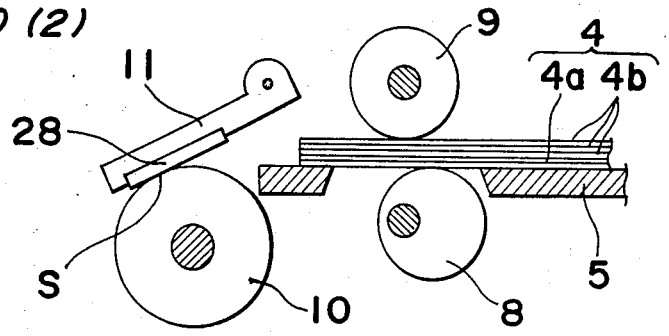
Figure 10:
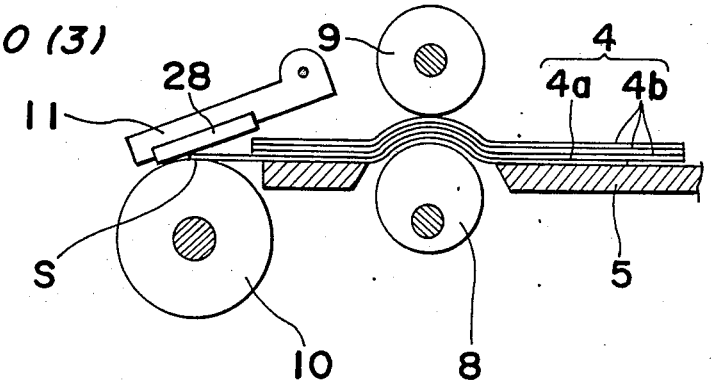

Referring further to FIGS. 9 and 10(1) through 10(3), with the procedure starting from step n1, upon operation of the electric source switch SW1, an electric power supply to the motor M at step n2 results in that the transport rollers 12*a* and 13*a* are driven thereby at step n3. At this moment, the feed rollers 8 are kept in a stop state at the first position where the feed rollers 8 sink below the document platform 5 as illustrated in FIG. 10(1) with increased paper set performance. At step n4, it is judged by the detecting means P2 whether the original documents 4 are set or not. In the case that the original documents 4 are set, the switch SW2 for transmission is operated at step n5, and thereafter, the feed rollers 8 and the paper feed roller 10 are driven for rotation thereof, with the electromagnetic clutches C1 and C2 being turned on at step n6. As a result, the lowest sheet 4*a* of the original documents 4 stacked one sheet upon another on the document platform 5 is transported between the paper feed roller 10 and the separating plate 11 by the feed rollers 8 in a state shown in FIG. 10(2) through a state in FIG. 10(3). Since the topmost one of the remaining original documents 4*b* is in contact with the lower surface of the separating plate 11, the transportation thereof is interrupted, and thus, the lowest one alone in a plurality of original documents 4 on the document platform 5 is led toward the paper feed roller 10 with certainty. Subsequently, at step n7, it is judged whether or not the leading end of the original document 4*a* having passed between the paper feed roller 10 and the separating plate 11 is detected by the detecting means P3. In the case that the leading end of the original document 4*a* is detected, the procedure proceeds to step n8 whereat the electromagnetic clutch C2 is turned off and the paper feed roller 10 in a free state rotates under the influence of inertia force thereafter. Meanwhile, upon detection of the second position indicated in FIG. 10(2) by the detecting means P1, the feed rollers 8 driven to rotate to the position, are brought to a halt to wait until the next original document 4 is transported.

At step n9, it is judged whether or not the trailing end of the original document 4*a* is detected by the detecting means P3 and in case of the detection thereof, it is judged whether or not any original document 4 is placed on the document platform 5 by the detecting means P2 at step n10. In the case that any original document remains thereon, the procedure returns to step n6 and thereafter, a plurality of original documents 4 are detected by turns, with the process from step n6 to step n10 being repeated in series.

At step n10, in the case that no original document 4 remains on the document platform 5, for example, in the case that the last one in a plurality of original documents 4 is detected or in the case that only one original document is fed or in the like case, the electromagnetic clutch C1 is turned on again for driving the feed rollers 8 to rotate, through the states indicated in FIG. 10(2) and FIG. 10(3), to the position indicated in FIG. 10(1) whereat the rollers 8 are kept in a stop state.

Accordingly, when the original documents 4 are set on the document platform 5 for transportation thereof, since the feed rollers 8 sink below the platform 5, the above described setting operation of the original documents 4 is easily carried out. Furthermore, since the feed rollers 8 are cylindrical in shape, an increased machining accuracy can be obtained owing to an easy machine-work, compared with the feed rollers 8 being polygonal, such as hexagonal or the like in shape. In addition, in the case that a plurality of original documents 4 are transported, the time required for transportation of the original documents 4 after the second sheet can be shortened, since the feed rollers 8 are in a standby state at a position immediately before the original documents 4 receive a force for transmission thereof, as shown in FIG. 10(2).

It is to be noted here that in the foregoing embodiment, although each of the feed rollers 8 is disposed on each side of the paper feed roller 10, the configuration and arrangement may be so modified that there are provided a pair of original document feed rollers and a feed roller, and each of original document feed rollers is disposed on each side of the feed roller.

Although the present invention has been fully described by way of example with reference to the accompanying drawings, it is to be noted that various changes and modifications will be apparent to those skilled in the art. Such changes and modifications are to be construed as included within the scope of the present invention as defined by the appended claims, unless they depart therefrom.

What is claimed is:

1. A paper supplying device which comprises:

first feed rollers eccentrically mounted on a horizontal rotational shaft, having convex feed surfaces whereby said feed rollers are capable of coming in contact with a first surface of a paper to be fed;

an urging means disposed so as to face said feed surfaces of said feed rollers, for urging said paper toward said feed rollers while contacting the other surface of said paper;

an interrupting means arranged at the downstream side of said first feed rollers with respect to a feeding direction of said paper, for interrupting the movement of remaining sheets of paper other than said paper in contact with said convex feed surfaces of said first feed rollers;

second feed means arranged at the downstream side of said first feed rollers with respect to said feeding direction of said paper, for feeding said paper in contact with said feed surfaces, according to an angular displacement of said first feed rollers; and a transport means arranged at a downstream side of said second feed means with respect to the feeding direction of said paper.

2. A paper supplying device as in claim 1, wherein said urging means comprises a pair of spaced pressure rollers having a rotary shaft, each end of which is loosely inserted in an elongated opening of respective holding members.

3. A paper supplying device as in claim 1, wherein said interrupting means includes a separating plate having a lower surface whereon a friction member is attached, and urged toward said second feed means by means of a spiral spring arranged on a supporting shaft mounted on said separating plate.

4. A paper supplying device as in claim 1, wherein said second feed means is a paper feed roller.

5. A paper supplying device in claim 1, wherein said transport means includes two sets of two pairs of spaced upper and lower transport rollers, each set of each pair of spaced rollers being disposed on each side of said second feed means.

* * * * *